US009147547B2

(12) United States Patent
Ji et al.

(10) Patent No.: US 9,147,547 B2
(45) Date of Patent: Sep. 29, 2015

(54) CIRCUIT BREAKER

(71) Applicant: Siemens Aktiengesellschaft, Munich (DE)

(72) Inventors: Peng Ji, Suzhou (CN); Deng Ke Zhang, Suzhou (CN)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/260,518

(22) Filed: Apr. 24, 2014

(65) Prior Publication Data

US 2014/0320241 A1 Oct. 30, 2014

(30) Foreign Application Priority Data

Apr. 28, 2013 (CN) ..... 2013 1 0156405

(51) Int. Cl.

| | |
|---|---|
| ***H01H 75/00*** | (2006.01) |
| ***H01H 77/00*** | (2006.01) |
| ***H01H 83/00*** | (2006.01) |
| ***H01H 71/74*** | (2006.01) |
| ***H01H 9/28*** | (2006.01) |
| ***H01H 71/10*** | (2006.01) |

(52) U.S. Cl.

CPC ..... *H01H 71/74* (2013.01); *H01H 9/285* (2013.01); *H01H 71/1054* (2013.01)

(58) Field of Classification Search

CPC ... H01H 71/74; H01H 71/1054; H01H 9/285; H01H 2071/508; H02B 11/133

USPC ..... 335/2, 6, 46, 167–176

See application file for complete search history.

(56) References Cited

U.S. PATENT DOCUMENTS

| | | | | |
|---|---|---|---|---|
| 4,001,742 | A * | 1/1977 | Jencks et al. | 335/173 |
| 5,831,503 | A | 11/1998 | Beck et al. | |
| 6,166,616 | A * | 12/2000 | Fischer et al. | 335/172 |
| 7,531,760 | B1 * | 5/2009 | Whipple et al. | 335/172 |
| 2011/0114458 | A1 * | 5/2011 | Lee | 200/43.08 |

FOREIGN PATENT DOCUMENTS

| | | |
|---|---|---|
| EP | 1587116 A1 | 10/2005 |
| EP | 2410549 A2 | 1/2012 |

OTHER PUBLICATIONS

Search Report for corresponding European patent application No. 14165407.9 dated Sep. 2, 2014.

* cited by examiner

*Primary Examiner* — Bernard Rojas

(74) *Attorney, Agent, or Firm* — Harness, Dickey & Pierce, P.L.C.

(57) ABSTRACT

Disclosed is a circuit breaker, including a housing; a trip rod and locking device being disposed in the housing. The locking device includes a lock head, a mounting portion, a sliding member and at least one elastic element. The mounting portion includes a base plate and a first side plate. At least one protruding portion is provided on the base plate and a through-hole is formed in the first side plate. The lock head includes a first driving member. The sliding member includes a body and a push rod. A second driving member and at least one mounting slot are formed on the body. The second driving member is mated with the first driving member and the protruding portion is located in the mounting slot. The push rod is formed on the body and can pass through the through-hole to trigger the trip rod.

18 Claims, 4 Drawing Sheets

CIRCUIT BREAKER

PRIORITY STATEMENT

The present application hereby claims priority under 35 U.S.C. §119 to Chinese patent application number CN 201310156405.X filed Apr. 28, 2013, the entire contents of which are hereby incorporated herein by reference.

TECHNICAL FIELD

At least one embodiment of the present invention generally relates to a circuit breaker, in particular to a circuit breaker having a locking device.

BACKGROUND ART

Circuit breaker attachments are being used ever more widely to expand and supplement the functionality of circuit breakers. Circuit breaker locking devices are one example of circuit breaker attachments. When a circuit on the load side of a circuit breaker requires maintenance or is not permitted to pass a current, a circuit breaker locking device can be used to lock the circuit breaker in the OFF position, in order to prevent other people from mistakenly closing the circuit breaker, and thereby ensure the safety or maintenance personnel or the reliable operation of electrical equipment. However, existing circuit breaker locking devices have quite complex structures, and must be installed and secured in place with a high degree of precision, making installation inconvenient.

SUMMARY

At least one embodiment of the present invention is directed to a circuit breaker having a locking device which has a simple structure and is convenient to install.

At least one embodiment of the present invention is realized by providing a circuit breaker, comprising a housing and a trip rod; the circuit breaker further comprises a locking device; the trip rod and the locking device are disposed in the housing; the locking device comprises a lock head, a mounting portion, a sliding member and at least one elastic element; the mounting portion comprises a base plate and a first side plate; at least one protruding portion is provided on the base plate; a through-hole is formed in the first side plate; the lock head comprises a first driving member; the sliding member comprises a body and a push rod; the body is slideably disposed on the base plate; a second driving member and at least one mounting slot are formed on the body; the second driving member is mated with the first driving member; the protruding portion is located in the mounting slot; the push rod is formed on the body and can pass through the through-hole to trigger the trip rod; the elastic element has one end connected to the protruding portion, and another end in contact with a part on the body which forms the mounting slot.

In one embodiment, the mounting portion further comprises a second side plate and a third side plate; the first side plate, the second side plate and the third side plate are disposed along edges of the base plate, connected one after another, the second side plate and the third side plate being disposed opposite each other; the second side plate and the third side plate are each provided with a guiding portion; the sliding member is slideably disposed between the base plate and the guiding portions.

The above description is merely an overview of embodiments of the present invention. In order that the technical aspects of the present invention may be understood more clearly, and implemented in accordance with the content of this Description, and in order to make the above and other objects, features and advantages of the present invention more obvious and easy to understand, preferred embodiments are explained in detail below with reference to the accompanying drawings.

DETAILED DESCRIPTION OF THE EXAMPLE EMBODIMENTS

Figure 1:
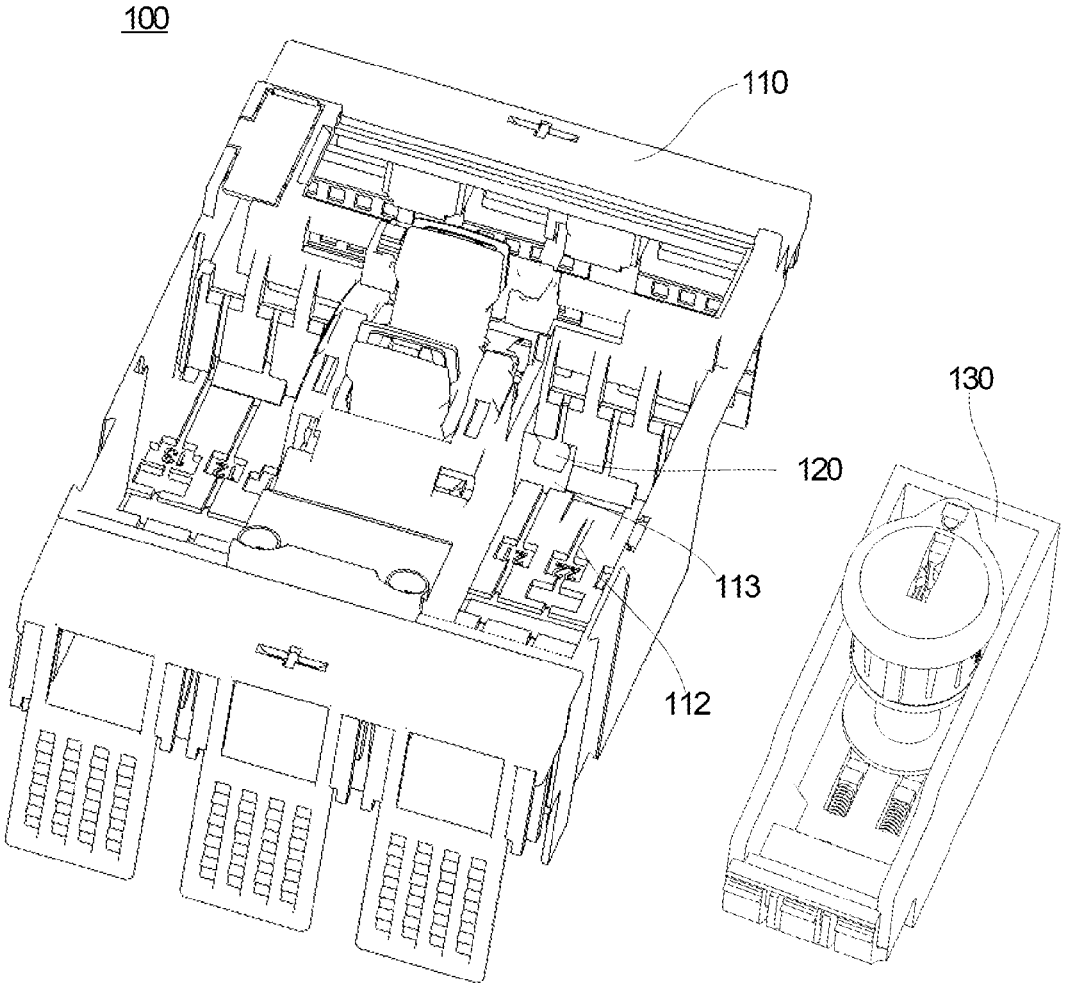
FIG. 1 is an exploded schematic diagram of a circuit breaker in one embodiment of the present invention.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Methods discussed below, some of which are illustrated by the flow charts, may be implemented by hardware, software, firmware, middleware, microcode, hardware description languages, or any combination thereof. When implemented in software, firmware, middleware or microcode, the program code or code segments to perform the necessary tasks will be stored in a machine or computer readable medium such as a storage medium or non-transitory computer readable medium. A processor(s) will perform the necessary tasks.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The present invention is explained in further detail below with reference to the accompanying drawings and embodiments, in order to clarify the technical solution which the present invention seeks to solve, as well as the technical solution and beneficial effects thereof. It should be understood that the particular embodiments described here are intended merely to explain the present invention, not to define it.

At least one embodiment of the present invention is directed to a circuit breaker having a locking device which has a simple structure and is convenient to install.

At least one embodiment of the present invention is realized by providing a circuit breaker, comprising a housing and a trip rod; the circuit breaker further comprises a locking device; the trip rod and the locking device are disposed in the housing; the locking device comprises a lock head, a mounting portion, a sliding member and at least one elastic element; the mounting portion comprises a base plate and a first side plate; at least one protruding portion is provided on the base plate; a through-hole is formed in the first side plate; the lock head comprises a first driving member; the sliding member comprises a body and a push rod; the body is slideably disposed on the base plate; a second driving member and at least one mounting slot are formed on the body; the second driving member is mated with the first driving member; the protruding portion is located in the mounting slot; the push rod is formed on the body and can pass through the through-hole to trigger the trip rod; the elastic element has one end connected to the protruding portion, and another end in contact with a part on the body which forms the mounting slot.

In one embodiment, one of the first driving member and the second driving member is moveably inserted in the other of the first driving member and the second driving member.

In one embodiment, the first driving member is a protruding structure or a groove structure; the second driving member is correspondingly a groove structure or a protruding structure formed on the body.

In one embodiment, the second driving member is a straight groove perpendicular to the sliding direction of the sliding member.

In one embodiment, the mounting slot is spaced from the second driving member and perpendicular thereto.

In one embodiment, the mounting portion further comprises a second side plate and a third side plate; the first side plate, the second side plate and the third side plate are disposed along edges of the base plate, connected one after another, the second side plate and the third side plate being disposed opposite each other; the second side plate and the third side plate are each provided with a guiding portion; the sliding member is slideably disposed between the base plate and the guiding portions.

In one embodiment, the body is in the form of a plate.

In one embodiment, the elastic element is a spring.

In one embodiment, a holding portion is formed in the housing; a perforation is formed in the holding portion; the locking device is disposed in the holding portion, and the push rod triggers the trip rod via the perforation and the through-hole.

In one embodiment, the first driving member is disposed eccentrically with respect to the rotation axis of the lock head.

The lock head and elastic element are used in the circuit breaker according to an embodiment of the present invention to control the sliding of the sliding member in the mounting portion and thereby lock or unlock the circuit breaker; the structure is simple, and facilitates mounting, disassembly and maintenance, while reliability is high and costs are relatively low.

FIG. 1 is a three-dimensional schematic diagram of a circuit breaker 100 in an embodiment of the present invention. As shown in FIG. 1, the circuit breaker 100 comprises a housing 110, a trip rod 120 and a locking device 130. The trip rod 120 and locking device 130 are disposed in the housing 110; the trip rod 120 can trip the circuit breaker 100; and the locking device 130 can trigger the trip rod 120 so that the circuit breaker 100 trips, and stays in a tripped state, i.e. prevent the circuit breaker 100 from opening or closing, and thereby ensure the safety of maintenance personnel or the reliable operation of electrical equipment.

In one embodiment, as FIG. 1 shows, a holding portion 112 is formed in the housing 110. The holding portion can be used to mount the locking device 130. In one embodiment, a perforation 113 is formed in the holding portion 112. The locking device 130 triggers the trip rod 120 via the perforation 113.

Figure 2:
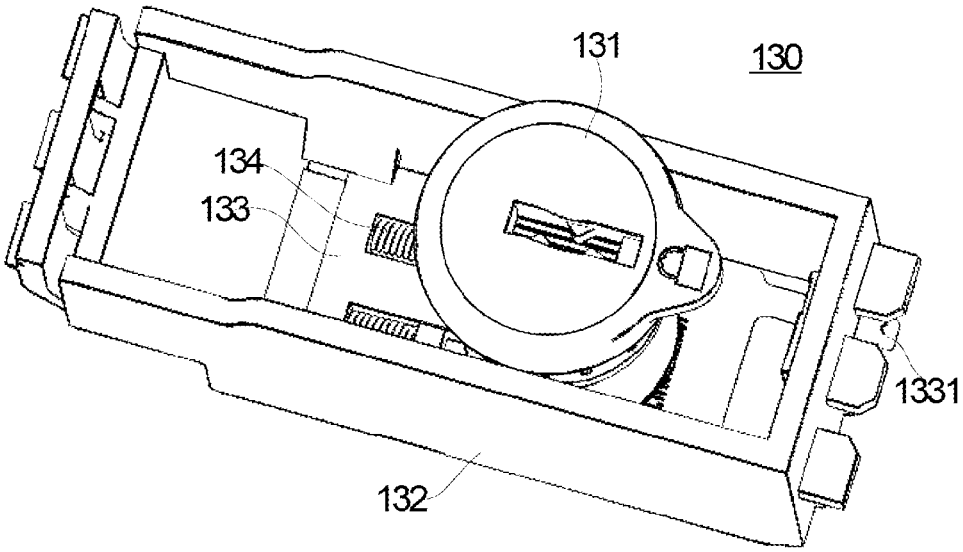
FIG. 2 is an enlarged schematic diagram of the locking device of the circuit breaker in FIG. 1.
Figure 3:
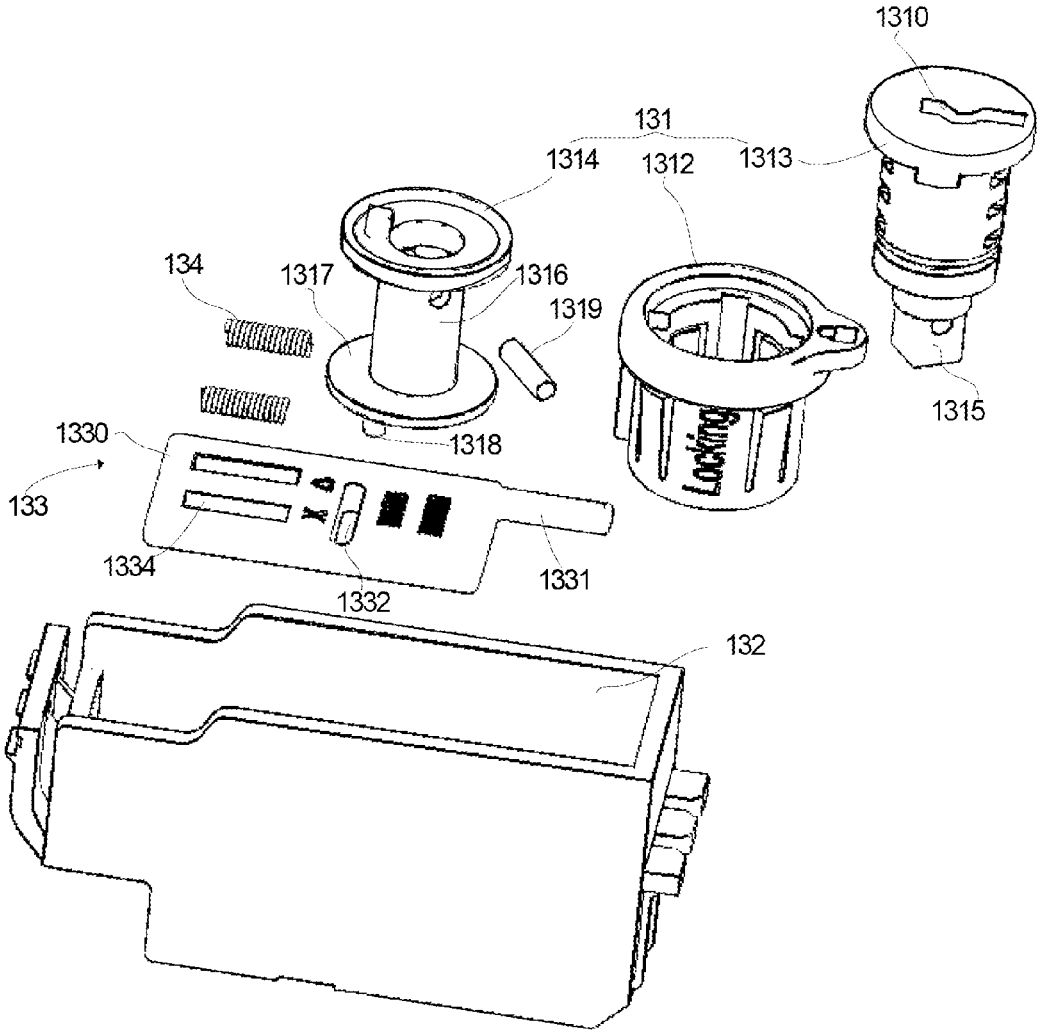
FIG. 3 is an exploded schematic diagram of the locking device in FIG. 2.

As FIGS. 2 and 3 show, the locking device 130 comprises a lock head 131, a mounting portion 132, a sliding member 133 and at least one elastic element 134. The lock head 131 can drive sliding movement of the sliding member 133 in the mounting portion 132, while the elastic element 134 can assist in driving the sliding member 133 to slide back to its initial position in the mounting portion 132.

Specifically, the lock head 131 comprises a fixed part 1312, a rotating part 1313 and a driving portion 1314. The fixed part 1312 is fixed on the housing 110, for example, on a cover (not shown in the figures) of the housing 110. The rotating part 1313 is rotatably mounted in the fixed part 1312. A lock hole 1310 allowing insertion of a key etc. is provided on an exposed end of the rotating part 1313. A first connecting portion 1315 is formed on that end of the rotating part 1313 which is located inside the housing 110, for connection to the driving portion 1314.

The driving portion 1314 comprises a second connecting portion 1316, a protruding portion 1317, a first driving member 1318 and a driving pin 1319. The second connecting portion 1316 and first connecting portion 1315 are connected together by means of the connecting pin 1319, so that the second connecting portion 1316 can rotate together with the rotating part 1313. The protruding portion 1317 is formed on an outer surface of the second connecting portion 1316. The first driving member 1318 is disposed on the protruding portion 1317, and used to drive the sliding member 133 disposed in the mounting portion 132.

In one embodiment, the second connecting portion 1316 is substantially cylindrical. The first connecting portion 1315 is inserted in the second connecting portion 1316, and connected to the second connecting portion 1316 by means of the connecting pin 1319. The protruding portion 1317 is a disk structure formed on the outer surface of the second connecting portion 1316. The first driving member 1318 is disposed on the protruding portion 1317 and does not pass through the axis or rotation axis of the second connecting portion 1316, i.e. the first driving member 1318 is disposed eccentrically with respect to the axis or rotation axis of the second connecting portion 1316. The first driving member 1318 may be a protruding structure formed on the protruding portion 1317 (as FIG. 3 shows).

Figure 4:
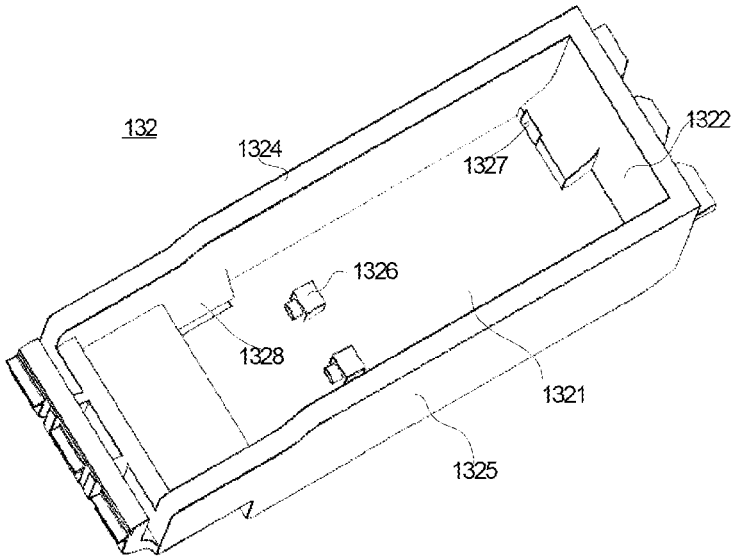
FIG. 4 is an enlarged schematic diagram of the mounting portion of the locking device in FIG. 3.

The mounting portion 132 can be mounted in the holding portion 112. As FIG. 4 shows, the mounting portion 132 comprises a base plate 1321, a first side plate 1322, a second side plate 1324 and a third side plate 1325. The first side plate 1322, second side plate 1324 and third side plate 1325 are disposed along the edges of the base plate 1321, connected one after another. In one embodiment, the first side plate 1322, second side plate 1324 and third side plate 1325 are disposed on the base plate 1321 so as to be substantially perpendicular, with the second side plate 1324 and third side plate 1325 being located opposite each other on two sides of the base plate 1321 and of the first side plate 1322.

At least one protruding portion 1326 is provided on the base plate 1321, for mounting the elastic element 134. In the embodiment shown in FIG. 4, two protruding parts 1326 which are spaced from one another are disposed on the base plate 1321.

The first side plate 1322 is disposed close to the trip rod 120 in the circuit breaker 100. A through-hole 1327 is formed in the first side plate 1322. The through-hole 1327 is disposed in a position corresponding to the trip rod 120 and perforation 113, to facilitate operation of the trip rod 120 by the sliding member 133 via the through-hole 1327 and perforation 113.

The second side plate 1324 and third side plate 1325 are each provided with a guiding portion 1328. The guiding portions 1328 are spaced from the base plate 1321, to allow the sliding member 133 to be slideably disposed between the base plate 1321 and the guiding portions 1328. The guiding portions 1328 can be used for guiding the sliding member 133 to slide inside the mounting portion 132 in a direction substantially parallel to the base plate 1321, while restricting movement of the sliding member 133 in a direction substantially perpendicular to the base plate 1321.

Figure 5:
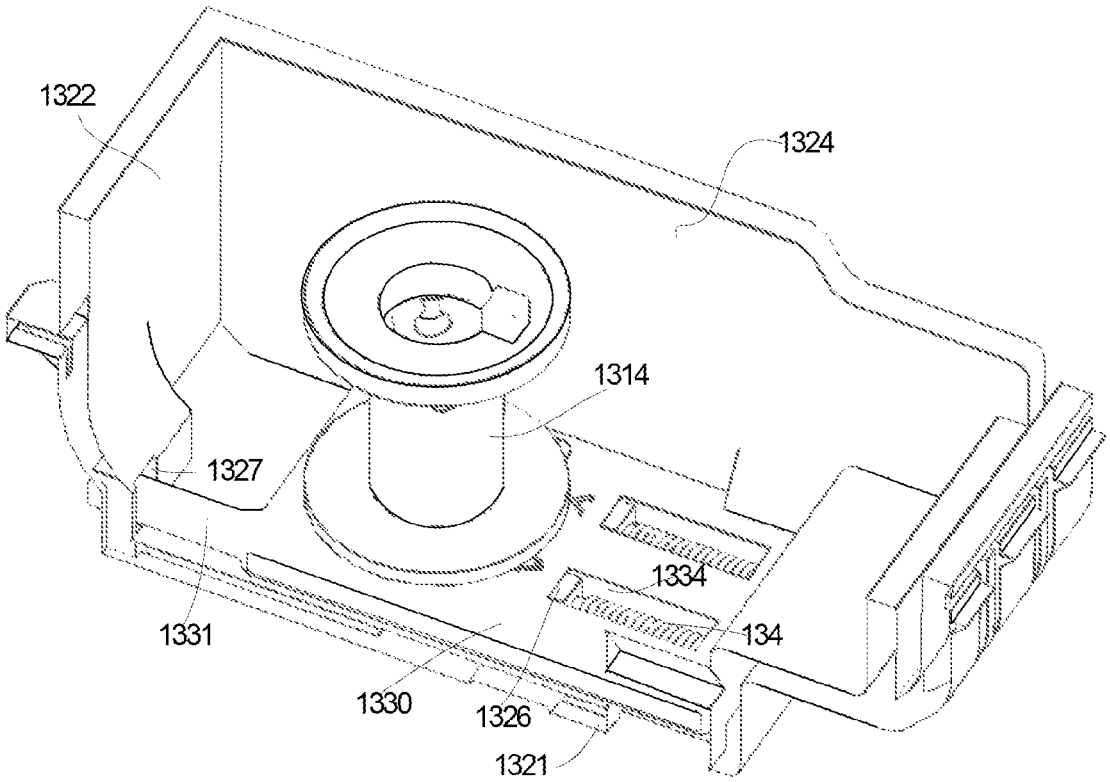
FIG. 5 is a schematic diagram showing the relationship between the sliding member and the mounting portion of the locking device.

The sliding member 133 is slideably disposed in the mounting portion 132. As FIGS. 3 and 5 show, the sliding member 133 comprises a body 1330 and a push rod 1331. The body 1330 may be a substantially rectangular plate structure. A second driving member 1332 and at least one mounting slot 1334 are formed on the body 1330. The second driving member 1332 and first driving member 1318 are mated with each other, enabling the lock head 131 to drive the sliding member 133 to slide inside the mounting portion 132. In the embodiment shown in FIG. 3, the second driving member 1332 may be a groove structure formed in the body 1330. For example, the second driving member 1332 may be a straight groove substantially perpendicular to the sliding direction of the sliding member 133. In other embodiments, the first driving member 1318 may be a groove structure formed in the protruding portion 1317, and correspondingly, the second driving member 1332 may be a protruding structure formed on the body 1330.

The mounting slot 1334 is spaced from the second driving member 1332, and substantially perpendicular thereto. In the embodiment shown in FIG. 3, two mounting slots 1334 are disposed in the body 1330 so as to be spaced apart, in positions corresponding to the protruding portions 1326; the two protruding portions are each located in a corresponding mounting slot 1334.

The push rod 1331 is formed on the body 1330, and disposed in a position corresponding to the through-hole 1327 and perforation 113. In one embodiment, the push rod 1331 is substantially perpendicular to the second driving member 1332.

The elastic element 134 may be a spring. The elastic element 134 is disposed in the mounting slot 1334. One end of the elastic element 134 is connected to the protruding portion 1326 located in the same mounting slot 1334, while the other end is in contact with a part on the body 1330 which forms the mounting slot 1334.

Described above is the specific structure of the locking device 130 in an embodiment of the present invention. A method of assembling the locking device 130 and a method of using the same are described briefly below.

To assemble, the sliding member 133 is disposed between the base plate 1321 and the guiding portions 1328, and the push rod 1331 is inserted in the through-hole 1327; the elastic element 134 is disposed in the mounting slot 1334, so that one end of the elastic element 134 is connected to the protruding portion 1326 located in the same mounting slot 1334, while the other end is in contact with a part on the body 1330 which forms the mounting slot 1334; and the first driving member 1318 is mated with the second driving member 1332, for example, the first driving member 1318 is inserted into the second driving member 1332, so the locking device 130 can be assembled quickly and conveniently. Once disposed in the housing 110, the locking device 130 can be used to lock or unlock the circuit breaker 100.

Figure 6:
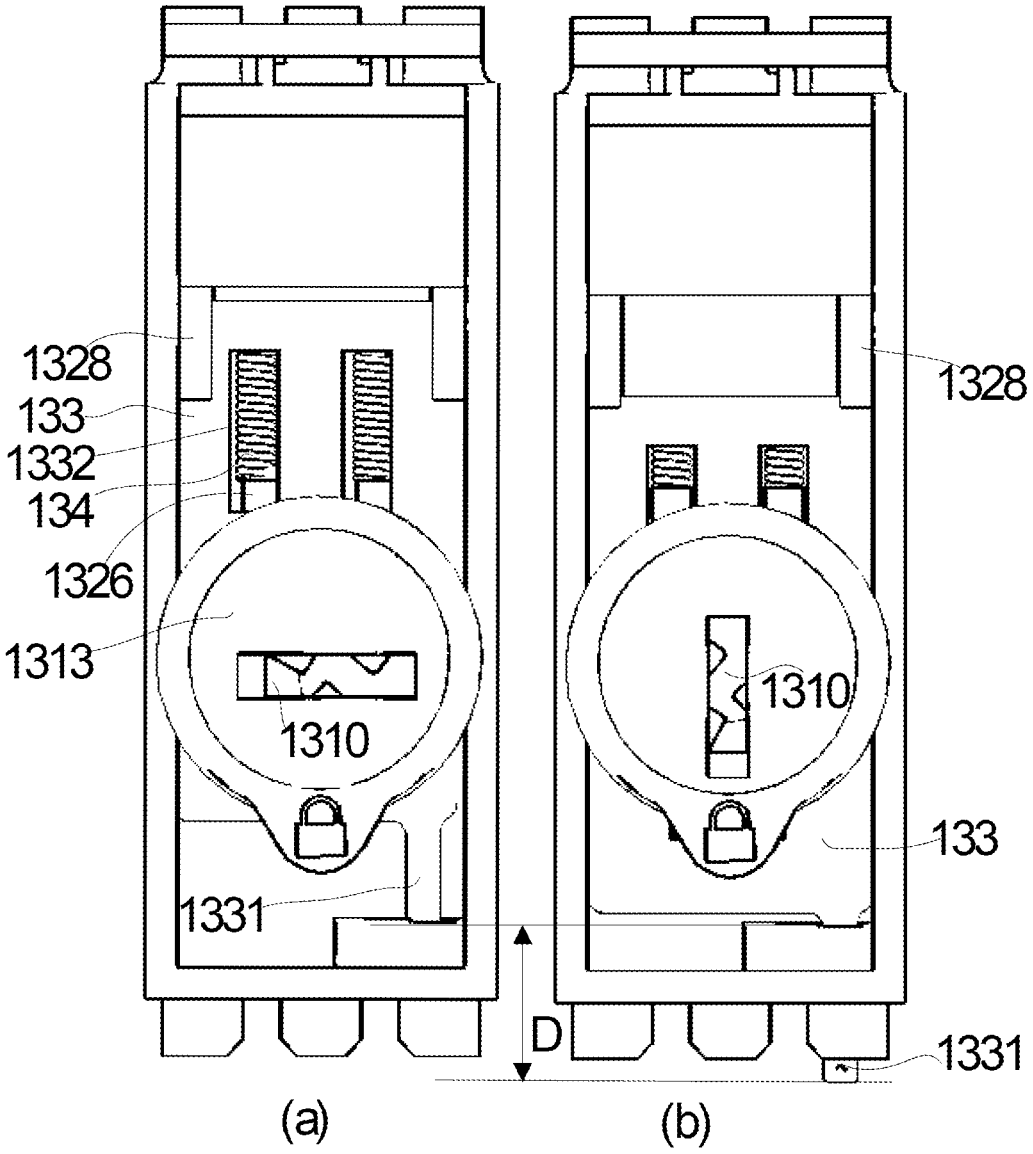
FIG. 6 is a schematic diagram showing the procedure for operating the locking device.

As FIG. 6*a* shows, the locking device 130 is in an unlocked position, so the circuit breaker 100 can open or close. When it is necessary to lock the circuit breaker 100, a key etc. is inserted in the lock hole 1310 and turned so that the rotating part 1313 of the lock head 131 turns through about 90 degrees from the position shown in FIG. 6*a* to the position shown in FIG. 6*b*; i.e. the locking device 130 can be used to lock the circuit breaker 100, so that the circuit breaker 100 cannot open or close. During this process, as FIG. 6 shows, when the rotating part 1313 of the lock head 131 begins to turn, driven by the key, the driving portion 1314 turns with it, causing the first driving member 1318 on the driving portion 1314 to move relative to the second driving member 1332 and push the sliding member 133 towards the trip rod 120. At the same time, the push rod 1331 passes through the through-hole 1327 and perforation 113 and moves towards the trip rod 120. When the rotating part 1313 of the lock head 131 turns through about 90 degrees to the position shown in FIG. 6*b*, the push rod 1331 moves a certain distance D, such as 5 mm, in the direction of movement of the sliding member 133, thereby pushing the trip rod 120 to trip the circuit breaker 100, so that the circuit breaker 100 cannot open or close, i.e. is locked. Thus the current-passing state (on/off) can be guaranteed, as can the lives of operators during maintenance work, with increased personal safety for staff.

During the above process, as the sliding member 133 moves towards the trip rod 120, the elastic element 134 is gradually compressed so as to store energy. When it is necessary to unlock the circuit breaker 100 so that it can open or close, the locking device 130 can be returned to the position shown in FIG. 6*a*, i.e. reset, by turning the key in the opposite direction. During this process, the elastic element 134 releases energy to assist in the resetting of the sliding member 133.

As stated above, the lock head 131 and elastic element 134 are used in the circuit breaker 100 in an embodiment of the present invention to control the sliding of the sliding member 133 in the mounting portion 132 and thereby lock or unlock the circuit breaker 100; the structure is simple, and facilitates mounting, disassembly and maintenance, while reliability is high and costs are relatively low.

In summary, disclosed in at least one embodiment of the present invention is a circuit breaker, comprising a housing and a trip rod; the circuit breaker further comprises a locking device; the trip rod and the locking device are disposed in the housing; the locking device comprises a lock head, a mounting portion, a sliding member and at least one elastic element; the mounting portion comprises a base plate and a first side plate; at least one protruding portion is provided on the base plate; a through-hole is formed in the first side plate; the lock head comprises a first driving member; the sliding member comprises a body and a push rod; the body is slideably disposed on the base plate; a second driving member and at least one mounting slot are formed on the body; the second driving member is mated with the first driving member; the protruding portion is located in the mounting slot; the push rod is formed on the body and can pass through the through-hole to trigger the trip rod; and two ends of the elastic element are in contact with the protruding portion and the body, respectively.

The above embodiments are merely preferred embodiments of the present invention, and are not intended to limit it. Any amendments, equivalent substitutions and improvements etc. made within the spirit and principles of the present invention should be included in the scope of protection thereof.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Although the invention has been illustrated and described in detail on the basis of the preferred example embodiment, the invention is not limited by the disclosed examples and other variations can be derived herefrom by the person skilled in the art, without departing from the scope of protection of the invention.

The labels in the accompanying drawings include:

100 circuit breaker
110 housing
112 holding portion
113 perforation
120 trip rod
130 locking device
131 lock head 1310
1310 lock hole
1312 fixed part
1313 rotating part
1314 driving portion
1315 first connecting portion
1316 second connecting portion
1317 protruding portion
1318 first driving member
1319 connecting pin
132 mounting portion
1321 base plate
1322 first side plate
1324 second side plate
1325 third side plate
1326 protruding portion
1327 through-hole
1328 guiding portion
133 sliding member
1330 body
1332 second driving member
1334 mounting slot
1331 push rod
134 elastic element
D distance

What is claimed is:

1. A circuit breaker, comprising:
a housing;
a trip rod; and
a locking device, the trip rod and the locking device being disposed in the housing, the locking device further including
a lock head including a first driving member,
a mounting portion including a base plate and a first side plate, at least one protruding portion being provided on the base plate and a through-hole being formed in the first side plate,
a sliding member including
a body and a push rod, the body being slideably disposed on the base plate,
a second driving member, and
at least one mounting slot formed on the body, the second driving member being mated with the first driving member the at least one protruding portion being located in the mounting slot and the push rod being formed on the body and being passable through the through-hole to trigger the trip rod, and
at least one elastic element, one end of the at least one elastic element being connected to the at least one protruding portion, and another end of the at least one elastic element being in contact with a part on the body which forms the mounting slot.

2. The circuit breaker of claim 1, wherein one of the first driving member and the second driving member is moveably inserted in another of the first driving member and the second driving member.

3. The circuit breaker of claim 2, wherein the first driving member is a protruding structure or a groove structure; and the second driving member is correspondingly a groove structure or a protruding structure formed on the body.

4. The circuit breaker of claim 3, wherein the second driving member is a straight groove perpendicular to the sliding direction of the sliding member.

5. The circuit breaker of claim 4, wherein the mounting slot is spaced from the second driving member and perpendicular thereto.

6. The circuit breaker of claim 1, wherein the mounting portion further comprises:
a second side plate and a third side plate, the first side plate, the second side plate and the third side plate being disposed along edges of the base plate, connected one after another, the second side plate and the third side plate being disposed opposite each other and the second side plate and the third side plate each being provided with a guiding portion, wherein the sliding member is slideably disposed between the base plate and the guiding portions.

7. The circuit breaker of claim 1, wherein the body is in the form of a plate.

8. The circuit breaker of claim 1, wherein the elastic element is a spring.

9. The circuit breaker of claim 1, wherein a holding portion is formed in the housing; a perforation is formed in the holding portion; the locking device is disposed in the holding portion; and the push rod triggers the trip rod via the perforation and the through-hole.

10. The circuit breaker of claim 1, wherein the first driving member is disposed eccentrically with respect to the rotation axis of the lock head.

11. The circuit breaker of claim 2, wherein the body is in the form of a plate.

12. The circuit breaker of claim 2, wherein the elastic element is a spring.

13. The circuit breaker of claim 2, wherein a holding portion is formed in the housing; a perforation is formed in the holding portion; the locking device is disposed in the holding portion; and the push rod triggers the trip rod via the perforation and the through-hole.

14. The circuit breaker of claim 2, wherein the first driving member is disposed eccentrically with respect to the rotation axis of the lock head.

15. The circuit breaker of claim 3, wherein the body is in the form of a plate.

16. The circuit breaker of claim 3, wherein the elastic element is a spring.

17. The circuit breaker of claim 3, wherein a holding portion is formed in the housing; a perforation is formed in the holding portion; the locking device is disposed in the holding portion; and the push rod triggers the trip rod via the perforation and the through-hole.

18. The circuit breaker of claim 3, wherein the first driving member is disposed eccentrically with respect to the rotation axis of the lock head.

* * * * *